United States Patent [19]

Alexander et al.

[11] 4,011,906

[45] Mar. 15, 1977

[54] DOWNHOLE VALVE FOR PARAFFIN CONTROL

[76] Inventors: Harvey C. Alexander, 610 W. 69th St., Odessa, Tex. 79762; Ray E. Hudson, 2422 Beechwood, Odessa, Tex. 79761

[22] Filed: Oct. 31, 1975

[21] Appl. No.: 627,477

[52] U.S. Cl. ..... 166/105; 166/303; 166/304; 166/321

[51] Int. Cl.[2] ..... E21B 37/00; E21B 43/00; E21B 43/24

[58] Field of Search ..... 166/304, 302, 57, 62, 166/68, 105, 224 A, 242, 303; 173/119, 78

[56] References Cited

UNITED STATES PATENTS

| | | | |
|---|---|---|---|
| 2,300,348 | 10/1942 | Dana | 166/304 X |
| 2,704,979 | 3/1955 | Van Willigen | 166/304 X |
| 3,014,531 | 12/1961 | Weaver | 166/304 X |
| 3,085,629 | 4/1963 | Henderson | 166/304 X |
| 3,086,593 | 4/1963 | Chitwood | 166/224 A |
| 3,102,590 | 9/1963 | Grounds | 166/224 A X |
| 3,361,205 | 1/1968 | Waldron | 166/304 |
| 3,695,365 | 10/1972 | Shädlich | 173/119 |
| 3,712,388 | 1/1973 | Curington | 173/78 |
| 3,713,490 | 1/1973 | Watson | 166/224 A X |

*Primary Examiner*—Stephen J. Novosad
*Attorney, Agent, or Firm*—Marcus L. Bates

[57] ABSTRACT

Method and apparatus for removing paraffin deposits from the production tubing of an oil well. A sub is series connected into the production string at a location below the area where deposition of paraffin occurs, and treatment fluid, such as hot water, is pumped downhole towards the inlet end of the string. A spring loaded valve means is located in a lateral flow passageway of the sub and opens when a pre-set tubing pressure is exceeded, thereby enabling the treatment fluid to be forced down the upper production tubing, past the paraffinic deposition, into the sub, through the lateral flow passageway, and into the casing annulus, thereby dissolving the crystalline paraffin so that the production tubing is no longer obstructed with paraffinic deposits.

9 Claims, 15 Drawing Figures

DOWNHOLE VALVE FOR PARAFFIN CONTROL

BACKGROUND OF THE INVENTION

In carrying out production of an oil well, wherein a pumpjack apparatus reciprocates a downhole pump device, the production zone often contains paraffinic hydrocarbons. The hydrocarbon zone usually is at an elevated temperature; and therefore, the paraffinic fraction of the liquid hydrocarbons are dissolved within the production fluid. As the production fluid is pumped uphole toward the surface of the ground, the temperature of the surrounding strata diminishes, especially when an aquifier near the surface of the earth is encountered. This produces a temperature gradient in the flowing production fluid. The reduction in temperature crystallizes the waxy or paraffinic material, and the paraffin commences to accumulate within a marginal length of the production tubing until the production rate diminishes to an unsatisfactory flow rate. In order to eliminate the deposition of the crystallized paraffin, various treatment fluids are sometimes introduced into the casing annulus. Still others have gone to great expense to install scraper devices on the sucker rod so that the deposited paraffin is mechanically scraped from the interior side wall of the production tubing. Still others have pumped treatment fluid downhole through the production string, through a bypass valve, into the casing annulus, thereby dissolving the paraffin deposits.

Installation of a bypass valve downhole in a borehole is limited by the design and construction of the biasing forces which cause the valve to remain in a closed configuration until a predetermined hydrostatic head is encountered to move the valve to the open position. Inasmuch as limited space is available, this expedient has heretofore been limited to very low pressure ranges which usually are unsuitable for hydrostatic heads encountered in most hydrocarbon producing wells.

Accordingly, it is desirable to be able to install a valve means downhill in a borehole wherein the valve means has associated therewith a novel valve construction which remains closed under an extremely high hydrostatic pressure, and which is able to be opened when still a greater pressure is artificially applied to the tubing string.

THE PRIOR ART

Tomlin, U.S. Pat. No. 3,376,936,
Waldron, U.S. Pat. No. 3,361,205,
Grounds, U.S. Pat. No. 3,102,590,
Henderson, U.S. Pat. No. 3,085,629,
Weaver, U.S. Pat. No. 3,014,531,
Dana, U.S. Pat. No. 2,300,348,
and to the art cited therein.

SUMMARY OF THE INVENTION

Method and apparatus for removing paraffin from a tubing string by series connecting a sub therewithin at a position which underlies the area subjected to the accumulated paraffin. A lateral flow passageway extends from the interior of the sub into the casing annulus. A valve means controls the flow of fluid through the lateral flow passageway of the sub. The valve means is closed at relatively low pressures and is moved to the open position under relatively high pressure. A ball check valve is biased into seated position by a caged set of bellville washers so that a tremendous opening force is required to unseat the ball; and at the same time, the bellville washers are housed within a cylinder so that they are isolated from the deleterious effects of debris which may flow through the lateral flow passageway.

In a second embodiment of the invention, the required opening force is greatly increased by the provision of a servo mechanism which includes a piston assembly. The servo mechanism augments the biasing action of the bellville washers.

A primary object of the present invention is the provision of apparatus for circulating treatment fluid downhole through a tubing string and into the casing annulus along a flow path which bypasses a downhole pump means.

Another object of the invention is the provision of improvements in production apparatus which enables paraffin to be removed from the production tubing string of an oil well.

A further object of this invention is the provision of oil well treatment apparatus having a valve means associated therewith which is normally closed, and which is moved to the open position only upon the provision of an extremely high hydrostatic head.

A still further object of this invention is the provision of improvements in a valve means for use in conjunction with a production tubing of an oil well having a pumpjack associated therewith by which the tubing string can be treated to remove paraffin deposits therefrom.

Another and still further object is the provision of apparatus for removing paraffin from the production string of an oil well by the application of treatment fluid to the string under a tremendous hydrostatic head, such that the treatment fluid dissolves the paraffin and bypasses the downhole pump while flowing into the casing annulus.

These and various other objects and advantages of the invention will become readily apparent to those skilled in the art upon reading the following detailed description and claims and by referring to the accompanying drawings.

The above objects are attained in accordance with the present invention by the provision of an apparatus which is fabricated in a manner substantially as described in the above abstract and summary.

DETAILED DESCRIPTION OF THE PREFERRED EMBODIMENTS

Throughout the various figures of the drawings, wherever it is logical to do so, like or similar numerals are employed to denote like or similar elements of the invention.

Figure 1:
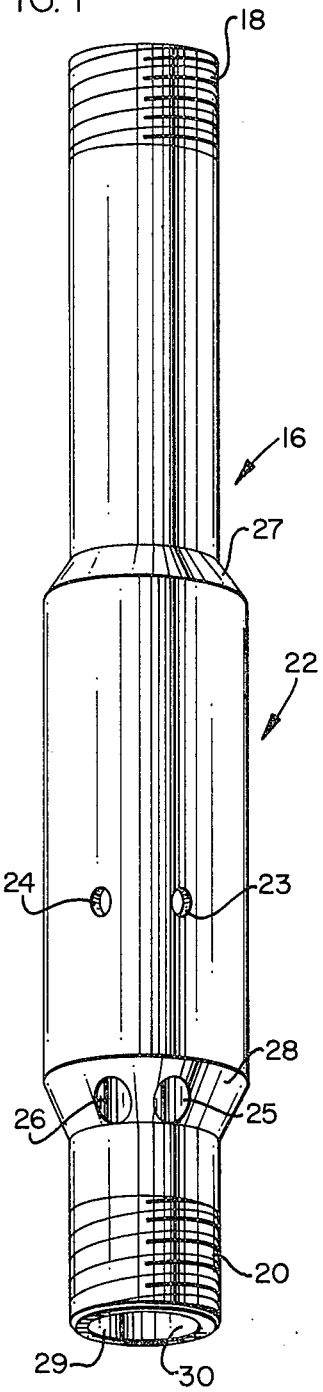
FIG. 1 is a perspective view of a tool sub made in accordance with the present invention.
Figure 2:
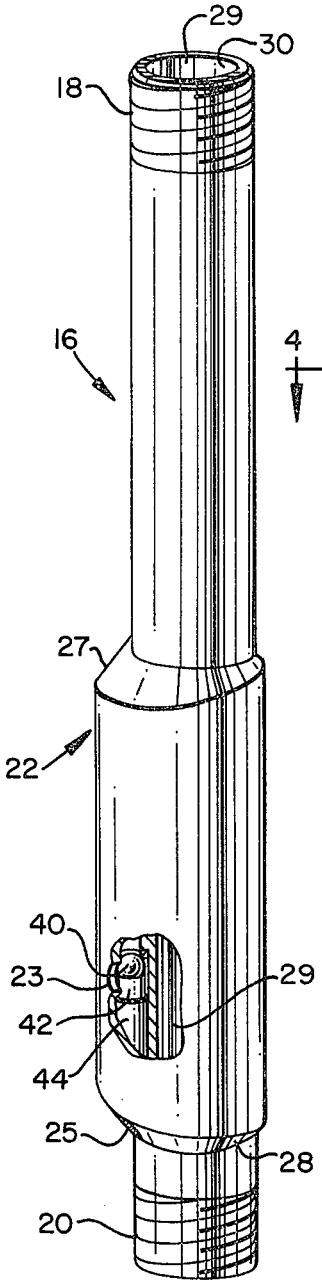
FIG. 2 is another perspective view of the tool sub disclosed in FIG. 1, with some parts being removed therefrom and some of the remaining parts being shown in crosssection.
Figure 3:
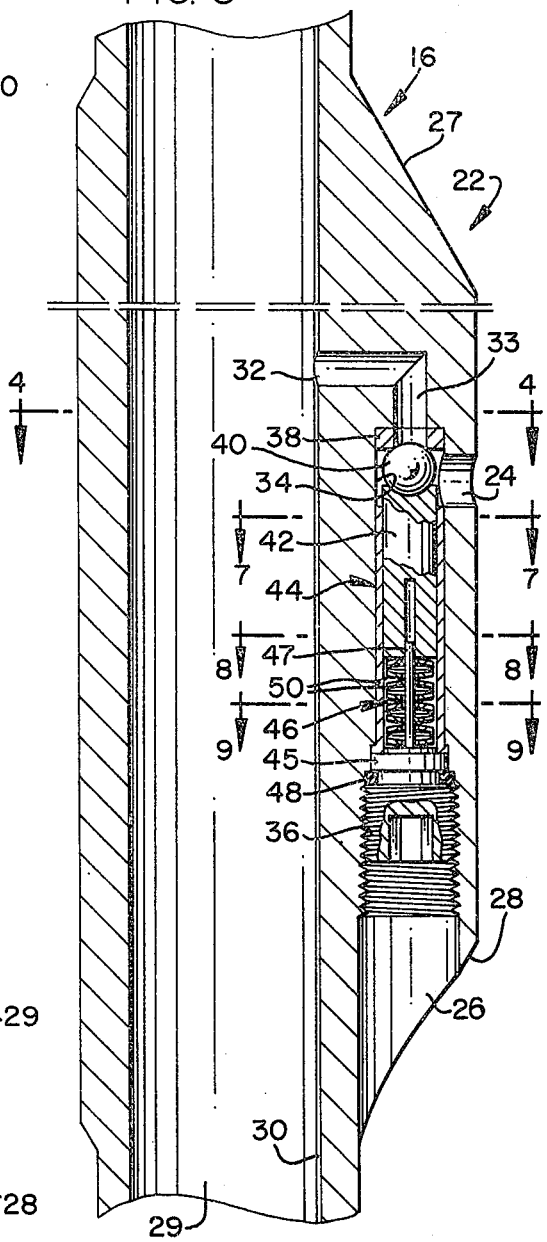
FIG. 3 is a fragmentary, enlarged, longitudinal cross-sectional view of the apparatus disclosed in the foregoing figures.

In FIGS. 1 and 2, there is disclosed a preferred form of the present invention. The invention is comprised of a tool sub 16, also called a sub-assembly, having threaded opposed marginal end portions 18 and 20 by which the sub can be series connected within the production tubing string associated with a hydrocarbon producing borehole. The sub has a central, enlarged portion 22 which is eccentrically disposed respective to the axial center line of the tubing string. Lateral ports, 23 and 24, are positioned within the cam-like, enlarged portion of the sub, while a pair of vertical parallel passageways, 25 and 26, are arranged normal to the lateral ports, and more or less parallel to the longitudinal central axis of the sub.

The enlargement 22 includes an upper sloped portion 27 and a lower sloped portion 28 formed thereon which facilitates running the tool into and out of a borehole. The sub is provided with an axial passageway 29 which is defined by the circumferentially extending interior wall 30. A passageway 32 communicates the axial bore 29 with a vertical passageway 33 which terminates at 26. The upper marginal end of the sub is of sufficient length to constitute a fishing neck.

The passageway 26 includes a working chamber 34 which extends downwardly to a threaded adjustment screw 36. The screw is threadedly received within a marginal threaded length of the passageway 26. The upper extremity of the working chamber is defined by a tungsten carbide seat 38 against which a tungsten carbide ball 40 is seated. Piston 42 is reciprocatingly received in low friction relationship within a marginal length of the working chamber and is slidably received in a telescoping manner within a cylindrical, upwardly opening cage 44. The slidable interface formed between the piston and the cage is of a sufficiently close tolerance fit to constitute a seal means. The interior 46 of the cylindrical cage houses a biasing means in the form of a plurality of stacked bellville washers 50. The base 45 of the cage is in the form of a closure member. An o-ring seal 48 prevents fluid flow about the cage.

Figure 4:
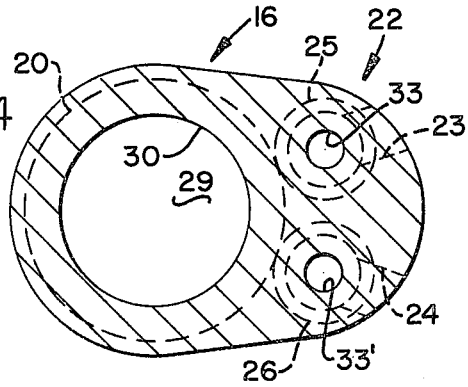
FIG. 4 is a cross-sectional view taken along line 4—4 of FIG. 3.

As seen disclosed in FIGS. 2 and 4, a plurality of parallel passageways may be positioned within the enlargement so that dual passageways, 33 and 33′, may be employed for a purpose which will be better appreciated later on in this disclosure.

Figure 5:
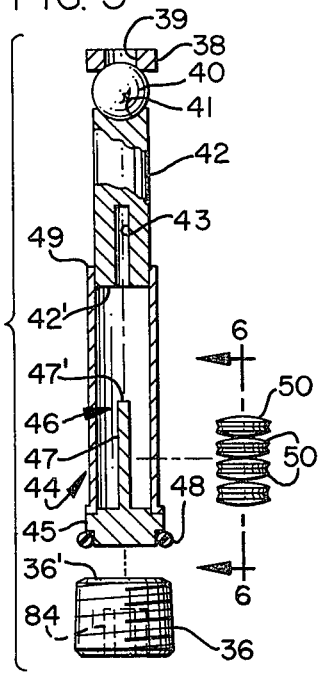
FIG. 5 is an enlarged, exploded, part cross-sectional, detailed view of part of the apparatus disclosed in FIG. 3.

As best seen illustrated in FIG. 5, the valve means of the first embodiment of the invention preferably includes the before mentioned special tungsten carbide seat 38. The seat is provided with a circumferentially extending side wall 39 which determines the force exerted on the special tungsten carbide ball 40 when a pressure is exerted within the axial passageway 29. The before mentioned piston 42 is provided with a concavity formed at 41 for positive seating of the ball thereagainst. The piston is vertically counterbored at 43 for telescopingly receiving a centrally disposed, upwardly extending alignment pin 47. The pin is positioned normally and centrally respective to the before mentioned base of the cage.

Where the relative diameter of the washer and the cage are of a value to maintain proper alignment of the respective washers, the pin 47 and bore 43 may be eliminated if desired.

Numeral 42′ indicates the lower annular end portion of the piston; numeral 47′ indicates the upper free or terminal end portion of the central alignment pin; while numeral 49 indicates the upper circumferentially extending terminal edge portion of the cylindrical cage. Hence, it can be seen that the base of the cylindrical cage engages the upper face 36′ of the adjustment screw in abutting relationship thereto.

Figure 6:
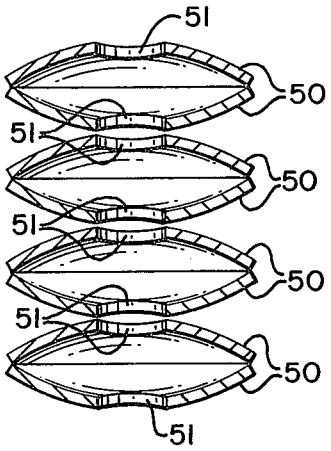
FIG. 6 is a cross-sectional view taken along line 6—6 of FIG. 5.
Figure 7:
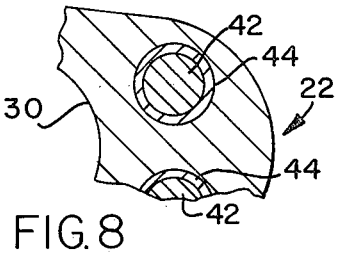
FIGS. 7, 8, and 9, respectively, are cross-sectional views taken along lines 7—7, 8—8, and 9—9, respectively, of FIG. 3.
Figure 8:
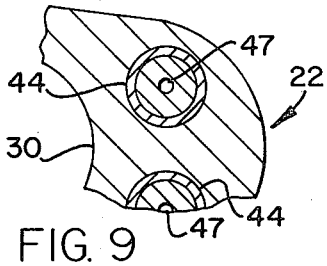
Figure 9:
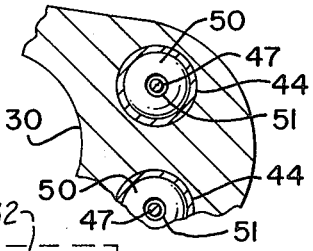

FIGS. 5 and 6 illustrate the configuration of the bellville washers, and it will be appreciated that pin 47 is received throughout the central aperture formed within the washers so that the deformed bell-like washers are maintained in stacked relationship respective to one another and to the cage. The washers are stacked in opposed pairs to provide a spring action of tremendous biasing force.

In the embodiment disclosed in FIGS. 10–14 of the present disclosure, there is seen a servo valve mechanism disposed within each of the working chambers of the sub. As best seen illustrated in FIG. 11, in conjunction with FIGS. 10 and 12–14, a piston assembly 142 is sealingly received in a reciprocating manner within a cylinder assembly 55. Upper surface 56 of the piston is provided with a concavity 58 for receiving a ball 40 in positive seated relationship thereon. A reduced diameter portion of the piston forms an opposed face 60 to form an annular area which is approximately 20 percent less than the measured cross-sectional area of the passageway 39 of the seat 38. Seal means 62 are expansion seal rings which sealingly engage the peripheral side wall 34 of the working chamber. The seal means can take on several different forms, but preferably are close tolerance metallic rings fitted within the illustrated piston grooves. Reduced diameter portion 64 of the piston terminates at the annular base 66 thereof. Small counterbore 67 formed in the lower end of the piston communicates with passageway 68, which extends through the entire piston assembly, thereby equalizing any pressures thereacross. Circumferentially extending interior side wall 70 defines a working chamber 72, within which an isolated biasing means in the form of a plurality of stacked bellville washers 50 are captured. The upper or opened end 74 of the cylinder is spaced from the annular area 60 sufficiently to provide ample working room for movement between the ball and seat. The lower end 78 of the cylinder is seated in seated relationship against the base of the adjustment screw 36, while o-ring 79 is positioned to prevent fluid flow across the cylinder.

Figure 10:
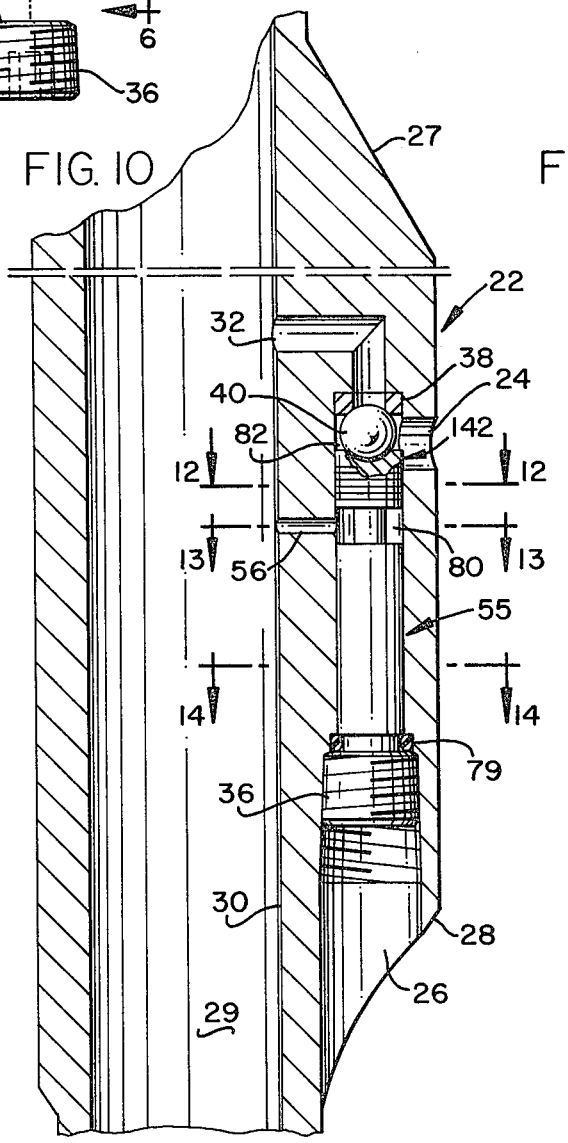
FIG. 10 is an enlarged, longitudinal cross-sectional view which sets forth a second embodiment of the present invention, and which is similar in some respects to the apparatus disclosed in FIG. 3.
Figure 11:
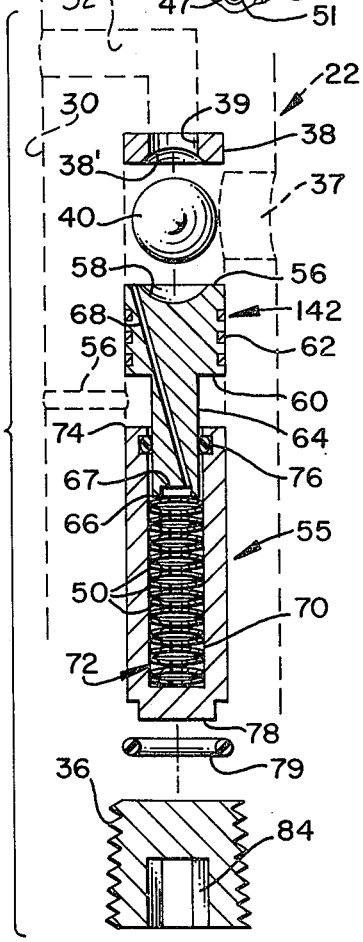
FIG. 11 is an enlarged, exploded, part diagrammatical, part cross-sectional, detailed view of some of the parts of the apparatus disclosed in FIG. 10.
Figure 12:
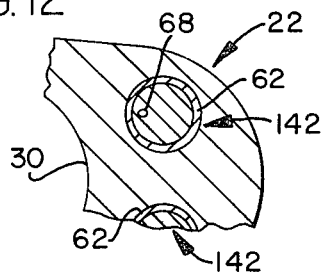
FIGS. 12, 13, and 14, respectively, are cross-sectional views taken along lines 12—12, 13—13, and 14—14, respectively, of FIG. 10; and, FIG. 15 is a part schematical, part diagrammatical representation of an operative embodiment of the present invention, and which discloses a method for carrying out one aspect of the present invention.
Figure 13:
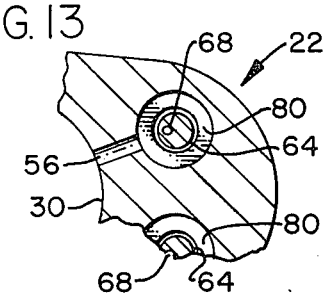
Figure 14:
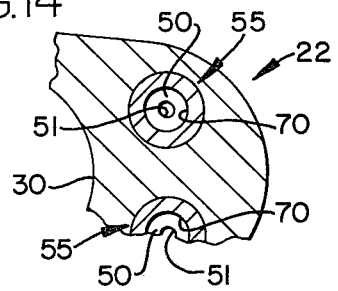

As best seen in FIG. 10, the before mentioned port 56 communicates the variable chamber 80 with the axial passageway 29 so that any pressure effected within the tubing string is also effected within the variable chamber as well as side 39 of the seat. Outlet chamber 82 communicates with the casing annulus by means of the port 24. The adjustment screw includes an internally formed, wrench-engaging surface 84, so that manual adjustment of the biasing force can be effected.

Figure 15:
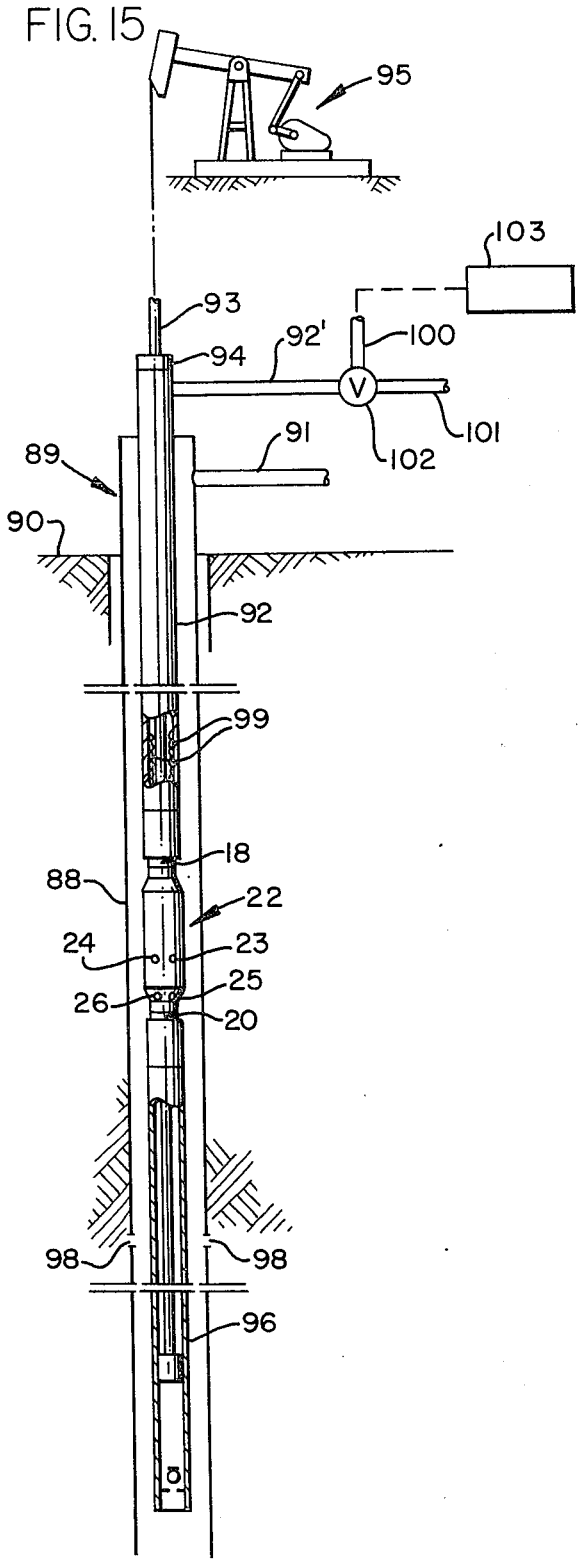

Looking now to the diagrammatical illustration of FIG. 15, a cased borehole 88 is seen to extend below the surface 90 of the ground. The casing annulus is connected to the usual above-ground piping 91, while production tubing 92 is connected to an outflow piping 92'. Sucker rod 93 is provided with the usual packing gland 94 and is reciprocated by a conventional pumpjack 95. A downhole pump 96 is suitably seated at 97 while formation fluid flows into the casing through the perforations 98.

A paraffin deposit 99 is seen to have previously accumulated above the tool sub 22 of the present invention. Piping 100 and 101 is connected to piping 92' by means of valve 102.

In operation, the sub of the present invention is positioned above the downhole pump and below the paraffin deposit. Over a prolonged period of time, the paraffin accumulates within the production tubing and must be removed to enhance the production rate. Accordingly, a source of treatment fluid 103 is connected to piping 100, while piping 101 is isolated from piping 92' by means of the valve 102. The treatment fluid is forced down the production tubing 92 by applying sufficient pressure at 100. When adequate pressure is applied to the axial passageway 29, the ball is unseated and the treatment fluid flows through port 32, passageway 33, and through port 24 into the casing annulus. The treatment fluid dissolves the paraffin deposits and translocates the deposits into the casing annulus. The well is thereafter returned to its normal production configuration until production data again indicates that another treatment of the well is desirable.

In the second embodiment of the invention disclosed in FIGS. 10–14, the servo piston 142 augments the action of the bellville washers in proportion to the ratio of the cross-sectional area of port 39 respective to the annular area 60 of the piston. This expedient enables the sub 22 to be placed downhole adjacent to the pump 96 so that the downhole production formation can be subjected to treatment during the paraffin removal operation.

The downhole pump apparatus is of conventional design and includes the usual standing valve and traveling valve associated therewith which normally precludes downhole flow of fluid. Accordingly, when sufficient fluid pressure in the form of treatment fluid is applied to the interior of production tubing, flow cannot occur through the downhole pump assembly; and therefore, flow must accordingly occur through the valve assembly located in the tool sub of the present invention. As stated above, sufficient hydrostatic pressure must be effected to overcome the biasing force of the valve in order to actuate the valve to the open position. This expedient enables a precise adjustment to be made to the biasing means prior to downhole installation of the tool sub. Accordingly, should an analysis of the specific borehole indicate that the tool sub should be placed at 1800 feet below ground level, for example, and further that the working well has 100 psi wellhead pressure, it then becomes apparent that the biasing means should be set to be actuated at some pressure in excess of 1200 psi, for example. This setting gives a margin of safety so that the balls are not cyclically lifted from their respective seats each stroke of the pump.

In one embodiment of the invention, a 5/16 inch diameter seat was employed while using a stack comprised of 24 pairs of bellville washers. This requires a total of 48 washers in each cage. The actual opening force presented by the washers can be set up to 2400 pounds force. The number of washers, the relationship of one washer to another, and the size of the washer, along with the configuration of the ball and the seat, can be varied as may be desired to accomodate various different downhole conditions.

By utilizing 48 (24 × 2) stacked bellville washers, the actual travel of the ball to full open position is less than 0.106 inches. The bellville washers may be fully collapsed with no resulting damage, which enhances the operative design of the present invention. The strength of the biasing force is determined by the thickness, diameter, and curvature of the washers.

The enclosure 44 and the cylinder 55 each encapsulate the bellville washers and prevent foreign debris from contaminating the biasing means. The enclosure 46 or 72 can be filled with a corrosion-preventing oil solution to further avoid contamination of the washers and any consequent disruption of operation or changes in setting over a prolonged period of time. The enclosure isolates the washers from the deleterious downhole conditions.

Dual passageways are provided within the valve assembly to provide adequate lateral flow. The tool sub is to small for a single passageway to produce the volume required to treat the tubing string. When hot water is used as a treatment fluid, it is desirable to translocate the water through the paraffin zone and through the valve as fast as possible to avoid any undue drop in temperature as the hot treatment fluid travels downhole. Furthermore, the quicker the well can be treated, it follows that less rig time will be involved, as well as the loss of production. Moreover, should one valve assembly clog, the second valve assembly can be utilized at reduced efficiency until the time arrives when the pump must be pulled for servicing, whereupon the tool sub of the instant invention can then be replaced with a more operative assembly.

The carbide ball and seat are necessary to prevent washout therebetween. Pressures up to 5000 psi are exerted across the seat. Therefore, abrasive foreign material erodes away other metallic substances.

One source of the bellville washers is Associated Spring Corporation, Dallas, Tex., part no. B0500–0255.

The tool of the present invention enables the paraffin deposits to be treated with hot water. The hot water cleans the tubing and rod string down to the bare metal and avoids the prior art necessity of utilizing hot oil for the treatment. The use of hot water is far less expensive, more convenient, and far less hazardous for handling and heating.

I claim:

1. In an oil well having a production string concentrically disposed within a borehole to form an annulus therebetween, a production pump at the end of the production string for pumping fluid up through the production string, a string of sucker rod leading down through the production string for actuating the pump from the surface of the ground, the improvement comprising:

a tool sub, means series connecting said sub within the production string at an intermediate position thereof;

said sub having an axial passageway formed therethrough, with the sucker rod extending through said axial passageway in spaced relationship to the side walls thereof;

an enlargement forming part of said sub and radially extending away from said axial passageway;

means defining a lateral passageway within said enlargement through which fluid can flow from said axial passageway into the casing annulus; means forming a working chamber which is in communication with said lateral passageway; a valve means positioned within said working chamber for controlling the flow of fluid through said lateral passageway;

said valve means includes a valve seat positioned within said lateral passageway, a valve element, a piston, a cylinder, and a spring means;

said valve element normally being forced into sealing engagement with said valve seat to prevent flow through said passageway, said piston having opposed ends with one end thereof being engaged against said valve element, said piston being reciprocatingly received in sealed relationship within said cylinder with said spring means being located within said cylinder and forced into engagement with the end of said piston which is opposed to said valve element, adjustment means by which said cylinder is forced towards said valve seat to thereby vary the biasing force of said spring means;

said end of said piston which is reciprocatingly received within said cylinder includes a reduced diameter marginal portion arranged such that said piston and cylinder form a variable chamber therebetween; means forming a bleed passageway from said axial passageway into said variable chamber; said lateral passageway includes an outlet which is formed between said piston and said valve seat so that when said valve element is displaced from said seat, flow can occur from said axial passageway, through said lateral flow passageway, including said seat, and into the annulus.

2. The improvement of claim 1 wherein said enlargement includes two said lateral flow passageways, a valve means located within the second of said two lateral flow passageways, said biasing means of each said valve means being a plurality of bellville washers stacked in opposed pairs, means by which said washers are maintained in aligned relationship respective to one another and adjustably positioned in abutting relationship respective to said valve means.

3. The improvement of claim 1 wherein said spring means including a stack of bellville washers arranged in pairs of opposed washers with the aperture of said washers being centrally aligned with one another.

4. The improvement of claim 1 wherein two adjacent parallel lateral flow passageways are included in said tool sub, with there being a second valve means located to control flow through the second recited lateral flow passageway.

5. The improvement of claim 1 wherein there is further included means forming a passageway which extends from the interior of said cylinder to said annulus to thereby effect the pressure in said annulus upon the lower side of the piston.

6. A tool sub, means for series connecting said sub within a marginal length of the production string of a well bore;

said sub having an axial passageway formed therethrough, such that a sucker rod of the well bore can extend through said axial passageway in spaced relationship to the side walls thereof;

said sub includes an enlargement integrally affixed thereto and radially extending away from said axial passageway;

means forming a lateral passageway within said enlargement through which fluid can flow from said axial passageway into the casing annulus, said passageway includes an inlet adjacent the axial passageway and an outlet leading away from said sub; a working chamber having opposed ends with one said opposed end being in communication with said lateral passageway; a valve means positioned within said working chamber for controlling the flow of fluid through said lateral passageway;

said valve means includes a cylinder slidably received within said working chamber, a piston having a large diameter end and a reduced diameter end, said reduced diameter end being reciprocatingly received within said cylinder;

spring means for biasing said piston away from said cylinder;

a valve seat positioned within said lateral flow passageway, a valve element, means by which said large end of said piston moves said valve element against said valve seat to control flow through said lateral passageway; and means forming a flow passageway from said axial passageway into said working chamber at a location between said large end of said piston and one end of said cylinder.

7. The apparatus of claim 6 wherein said enlargement includes two said lateral flow passageways, a valve means located within the second of said two lateral flow passageways;

said biasing means of each said valve means being a plurality of bellville washers stacked in opposed pairs, means by which said washers are maintained in aligned relationship respective to one another and adjustably positioned in abutting relationship respective to said valve means.

8. The apparatus of claim 6 and further including means forming a passageway which communicates said outlet of said lateral passageway with the interior of said cylinder to thereby enable fluid pressure to be effected upon the reduced diameter part of said piston.

9. The apparatus of claim 6 wherein said spring means includes a stack of bellville washers arranged in pairs of opposed washers with the aperture of said washers being centrally aligned with one another.

* * * * *

UNITED STATES PATENT OFFICE

CERTIFICATE OF CORRECTION

PATENT NO. : 4,011,906

DATED : March 15, 1977

INVENTOR(S) : Marvey C. Alexander and Ray E. Hudson

It is certified that error appears in the above-identified patent and that said Letters Patent are hereby corrected as shown below:

Column 6, line 48, insert --any-- after "Therefore,".

Column 7, Claim 1, line 24, insert --lateral-- before "passageway".

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*